US011464254B2

(12) United States Patent
Anthony

(10) Patent No.: US 11,464,254 B2
(45) Date of Patent: Oct. 11, 2022

(54) BUTANE-FREE SMOKING DEVICE

(71) Applicant: Dustin Anthony, San Diego, CA (US)

(72) Inventor: Dustin Anthony, San Diego, CA (US)

( * ) Notice: Subject to any disclaimer, the term of this patent is extended or adjusted under 35 U.S.C. 154(b) by 198 days.

(21) Appl. No.: 17/031,498

(22) Filed: Sep. 24, 2020

(65) Prior Publication Data

US 2021/0084968 A1 Mar. 25, 2021

Related U.S. Application Data

(60) Provisional application No. 62/905,620, filed on Sep. 25, 2019.

(51) Int. Cl.
*A24F 1/24* (2006.01)
*A24F 5/10* (2006.01)
(Continued)

(52) U.S. Cl.
CPC ..... *A24F 5/10* (2013.01); *A24F 1/10* (2013.01); *A24F 5/04* (2013.01); *A24F 2700/03* (2013.01); *A24F 2700/08* (2013.01)

(58) Field of Classification Search
CPC ..... A24F 1/24; A24F 5/04; A24F 5/10; A24F 2700/08
See application file for complete search history.

(56) References Cited

U.S. PATENT DOCUMENTS 437,070 A 9/1890 Wiesebrock
1,065,372 A * 6/1913 Kieser ..... A24F 5/10 131/183
(Continued)

FOREIGN PATENT DOCUMENTS

DE 202005015796 U1 * 1/2006 ..... A24F 1/30

OTHER PUBLICATIONS

Acute Exposure Guideline Levels for Selected Airborne Chemicals: vol. 12, Committee on Acute Exposure Guideline Levels; Committee onToxicology; Board on Environmental Studies and Toxicology; Division on Earth and Life Studies; National Research Council, 2012.
(Continued)

*Primary Examiner* — Cynthia Szewczyk
(74) *Attorney, Agent, or Firm* — Guy Cumberbatch

(57) ABSTRACT

A smoking device which permits combustion and inhalation of smoking material without also inhaling gases from a source of combustion such as lighter. The smoking device has a main body with a lower end adapted to connect to an overall smoking system. A lower portion of the main body defines internal flow channels, while an upper portion defines a smoking chamber therein. A burn plate or disc is clamped against an inner ledge in the lower end of the smoking chamber which is enclosed by a lid having an air inlet. The smoking chamber may house a manifold member which clamps the burn plate against an inner ledge. A user places smoking material on the burn plate and closes the smoking chamber with the lid. While applying a lighter flame directed into the lateral throughbore to the underside of the burn plate, the user applies suction to the lower inhalation passageway which pulls air in through the air inlet in the lid. Combustion of the smoking material creates smoke which is ported through the smoking device to the user without pulling in any of the gases from the lighter flame.

21 Claims, 5 Drawing Sheets

(51) Int. Cl.
*A24F 5/04* (2006.01)
*A24F 1/10* (2006.01)

(56) References Cited

U.S. PATENT DOCUMENTS

| | | | | |
|---|---|---|---|---|
| 1,071,389 | A | 8/1918 | Blosser | |
| 1,405,802 | A | 2/1922 | Phelan | |
| 1,531,094 | A * | 3/1925 | Hermanson | A24F 5/08 131/196 |
| 5,678,573 | A * | 10/1997 | Aldin, Sr. | A24F 5/00 131/226 |
| 6,481,437 | B1 | 11/2002 | Pate | |
| 8,733,345 | B2 | 5/2014 | Siller | |
| 8,783,265 | B2 * | 7/2014 | Shakouri Moghadam | A24F 1/30 131/196 |
| 2007/0215164 | A1 * | 9/2007 | Mehio | A24F 1/30 131/173 |
| 2009/0032034 | A1 | 2/2009 | Steinberg | |
| 2009/0293888 | A1 | 12/2009 | Williams | |
| 2015/0075544 | A1 * | 3/2015 | Portz | A24F 5/00 131/226 |

OTHER PUBLICATIONS

How-to-Smoke-Dabs-Without-a-Rig, Yo Dabba Dabba website, https://yodabbadabba.com/dabbing-resources/smoke-wax-without-a-rig/—downloaded Jul. 29, 2019.

Need-a-Light-4Alternatives-to-Using-a-Lighter, Leafly website, https://www.leafly.com/news/strains-products/alternatives-to-using-a-lighter—downloaded Jul. 29, 2019.

* cited by examiner

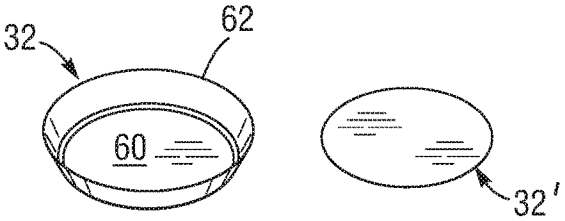
FIG. 4B
FIG. 4A
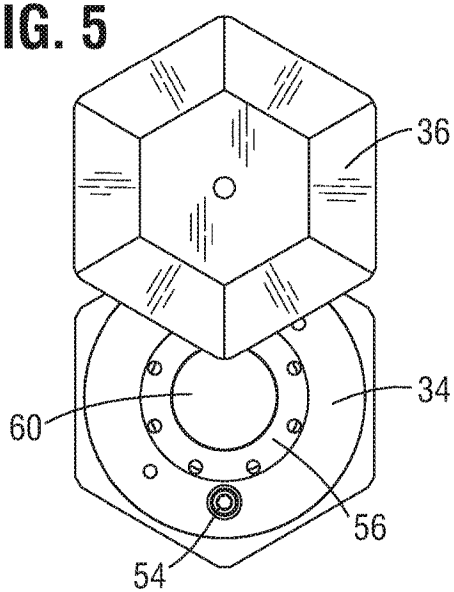
FIG. 5
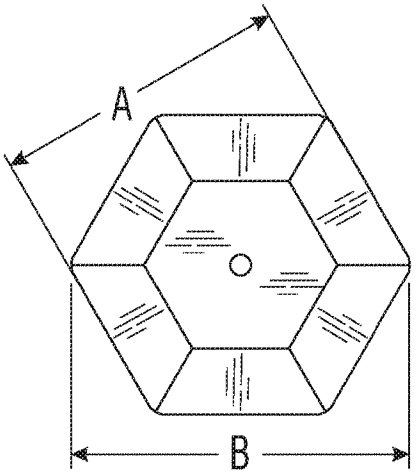
FIG. 3C
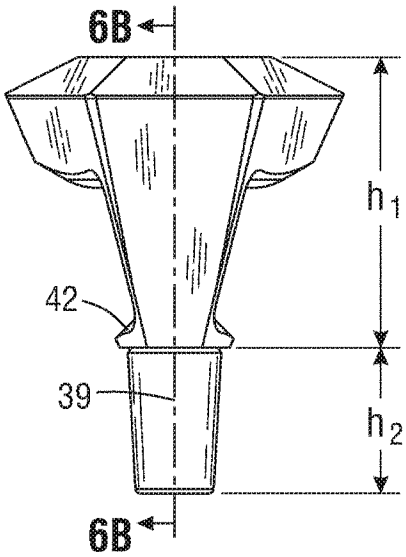
FIG. 3B
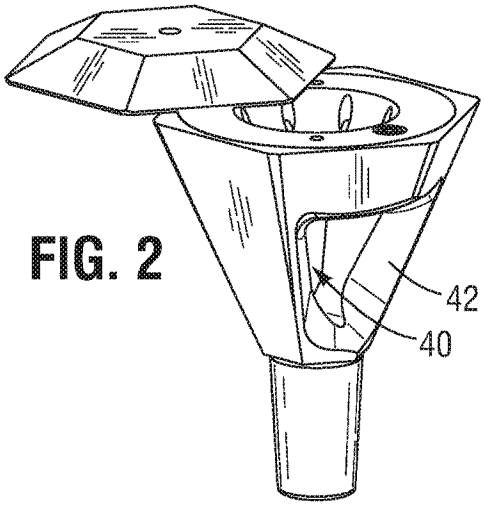
FIG. 2
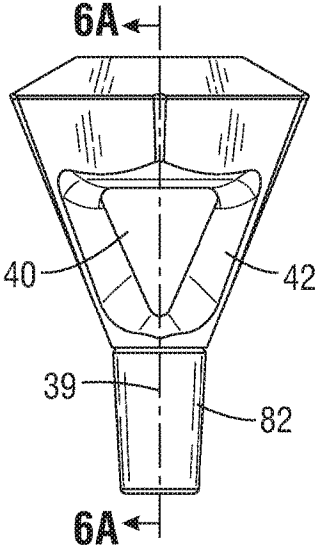
FIG. 3A

BUTANE-FREE SMOKING DEVICE

RELATED APPLICATIONS

The present application claims priority under 35 U.S.C. 119 to U.S. Provisional Application Ser. No. 62/905,620, filed Sep. 25, 2019, the contents of which are expressly incorporated herein by reference.

FIELD OF THE INVENTION

The present invention is directed to a smoking device that prevents the user from inhaling gases produced by a source of ignition such as a lighter.

BACKGROUND OF THE INVENTION

Butane is a colorless gas with a faint disagreeable odor, although it is considered to be odorless by some. Butane is produced from natural gas. Its main uses are in the production of chemicals like ethylene and 1,3-butadiene, as a refrigerant, as an aerosol propellant, as a constituent in liquefied petroleum gas, and as the main component of gas lighter refills. Because it is easily accessible, butane is often used in inhalant abuse. Though the toxicity of butane is low, huge exposure concentrations can be assumed in butane abuse. The predominant effects observed in abuse cases are central nervous system (CNS) and cardiac effects. Case studies also reveal that serious brain damage and underdeveloped organs can occur in fetuses in case of high single exposures during the week 27 or 30 of pregnancy (Acute Exposure Guideline Levels for Selected Airborne Chemicals: Volume 12—Butane: Acute Exposure Guideline Levels, National Academies Press ©2012 by the National Academy of Sciences).

Butane lighters are universally regarded as one of the easiest and most convenient ways to combust smokable material such as tobacco or *cannabis*. Lighters are compact, inexpensive, and reliable tools. Because of the ubiquitous status of lighters for smokers, researchers fear that repeated exposure to gases produced from butane combustion may lead to harmful effects. Indeed, online discussions provide numerous alternatives for those wishing to avoid butane fumes. For instance, hemp wick, or hemp twine that has been dipped in beeswax, is fairly popular among the butane-free smoking community, but of course emits gasses as well. So-called flame-free lighters use plasma coils (sometimes referred to as arcs), which heat to an incredibly high temperature that is capable of combusting smoking material. These flame-free lighters can be expensive. Glass wands (also referred to as greevo sticks) are heated up until red hot, cooled for a few seconds, and then pressed against the smoking material for instant vaporization/combustion. Glass wands are fragile.

Despite attempts to eliminate inhalation of butane, there remains a need for a simple and convenient way to combust smoking material without the drawbacks of known alternatives.

SUMMARY OF THE INVENTION

The present application provides an improved smoking device which permits combustion and inhalation of smoking material without also inhaling gases from a source of combustion such as lighter. The smoking device has a main body with a lower end adapted to connect to an overall smoking system such as a pipe or a bong. A lower portion of the main body has a lateral throughbore, while an upper portion defines a smoking chamber therein. A burn plate or disc rests at the lower end of the smoking chamber and is exposed to the lateral throughbore. The smoking chamber is enclosed by a lid and houses a manifold member which clamps the burn plate against an inner ledge of the main body. The manifold member has ports which lead to channels through the main body and to a lower inhalation passageway. A user places smoking material on the burn plate and closes the smoking chamber with the lid. While applying a flame directed into the lateral throughbore to the underside of the burn plate, the user applies suction to the lower inhalation passageway which pulls air in through a central port in the lid. Combustion of the smoking material creates smoke which is ported through the smoking device to the user without pulling in any of the gases from the lighter flame.

A further understanding of the nature and advantages of the invention will become apparent by reference to the remaining portions of the specification and drawings.

BRIEF DESCRIPTION OF THE DRAWINGS

Features and advantages of the present invention will become appreciated and become better understood with reference to the specification, claims, and appended drawings wherein:

FIG. 2 is an assembled perspective view of the smoking device with a lid partially removed;

FIGS. 3A and 3B are side elevational views of the smoking device, and FIG. 3C is a top plan view thereof;

FIGS. 4A and 4B are perspective views of alternative forms of burn plates that can be used in the exemplary smoking device;

FIG. 5 is a top plan view of the exemplary smoking device with a lid partially removed;

DETAILED DESCRIPTION OF THE PREFERRED EMBODIMENTS

The present application presents an improved smoking device which greatly reduces if not eliminates inhalation of gases generated by a combustion source such as a butane lighter. The smoking device is adaptable for use as the outer end of a hand-held pipe or may be connected to a larger smoking system such as a hookah or bong. The smoking device is suitable for combustion of a variety of smokable solid substances, such as one or more of tobacco, dried leaves such as stinging nettle or jimson weed, marijuana and other forms of smokable *cannabis*, or herbs such as cloves. The smoking device is also adaptable for full or partial combustion of liquids such as oils of any of the aforementioned solid substances. All of these solid materials or liquid substances individually or collectively will be termed smoking material herein.

The present application describes devices which separate the desirable smoke from the undesirable gasses produced by a combustion source such as a butane lighter. In this context, combustion sources include any heat source capable of combusting smokable material, such as lighters that us butane or naptha (e.g., Zippo lighters), matches, hemp wicks, etc.

Figure 1A:
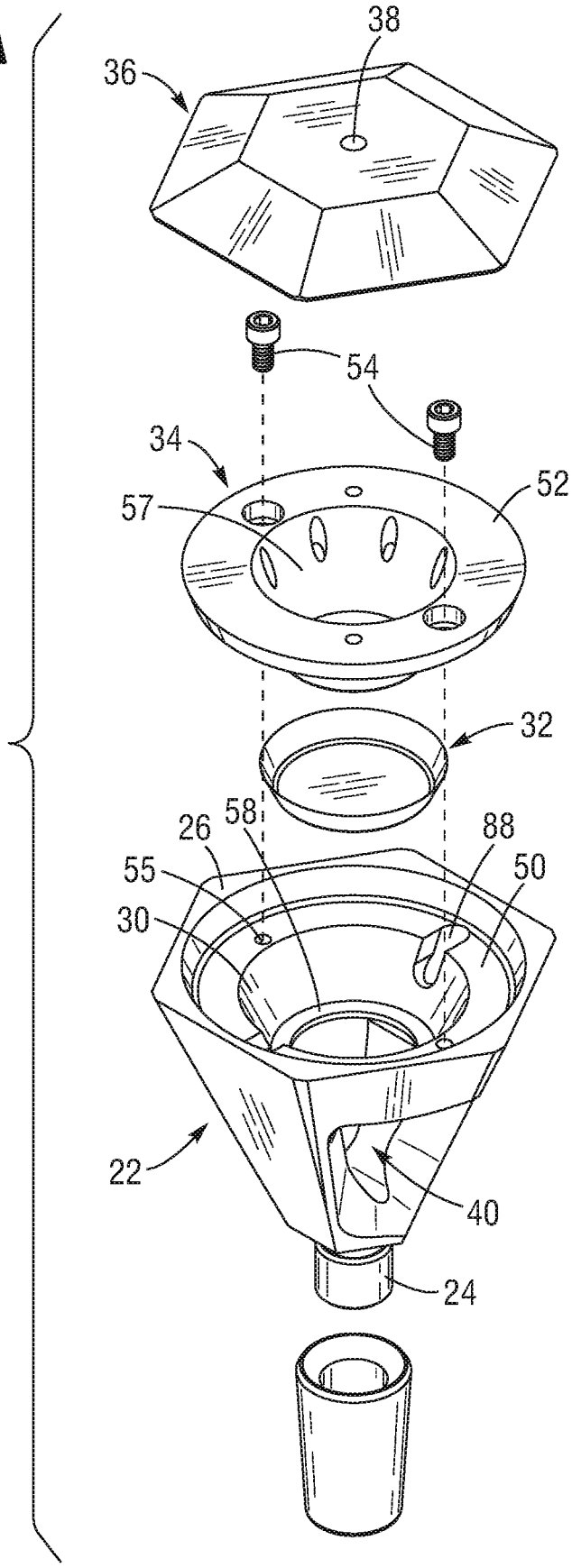
FIG. 1A is an exploded perspective view of an exemplary construction of the butane-free smoking device of the present application.

FIG. 1A is an exploded perspective view of an exemplary construction of the butane-free smoking device 20 of the present application. The smoking device 20 includes a main body 22 that tapers wider from a lower end 24 to an upper end 26. The main body 22 defines an inner tapered smoking chamber 30 that opens upward and is sized to receive a burn plate or disc 32 and a manifold member 34. A lid 36 and attaches to the upper end 26 of the main body 22 and substantially covers the smoking chamber 30 and the components therein. Notably, a central intake port 38 passes vertically through the lid 36.

Figure 1B:
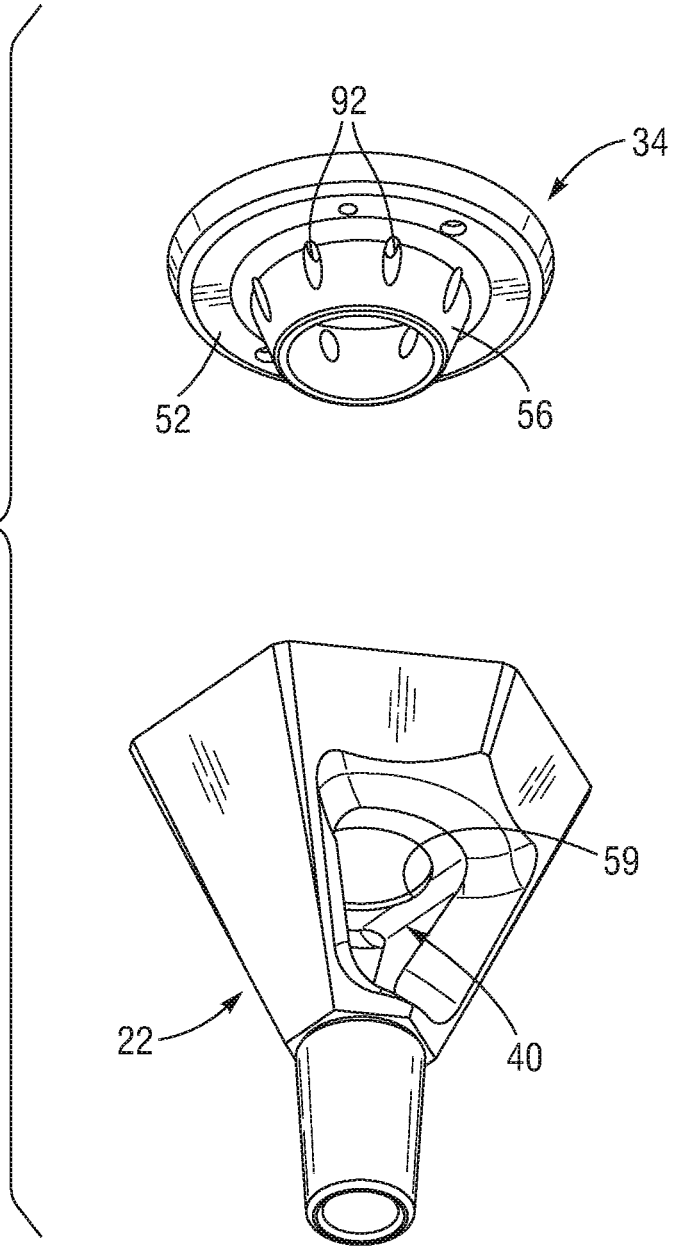
FIG. 1B is a perspective view of just a main body and exploded manifold member thereof.

With reference to FIGS. 1A and 1B and the side elevational views of FIGS. 3A and 3B, the main body 22 defines a longitudinal axis 39 and a generally triangular throughbore 40 extending laterally through a lower portion thereof. The throughbore 40 is formed by inner surfaces 42 of a pair of hollow legs 44 that connects an upper portion of the main body 22 to the lower end 24. The inner surfaces 42 are recessed radially inward so that relatively wide entrances are provided for the triangular throughbore 40. As will be described below, these wide entrances enable a user to direct a lighter or other combustion source flame into the throughbore 40 to contact an underside of the burn plate 32 and combust the smoking material within the smoking chamber 30.

With reference back to FIGS. 1A and 1B, the main body 22 defines an inner ledge 50 just below the upper end 26 size to closely receive an upper flange 52 of the manifold member 34. The manifold member 34 may be secured within the chamber 30 using a pair of threaded fasteners 54 that extends through openings in the flange 52 and are received within threaded bores 55 in the inner ledge 50. FIG. 5 is a top plan view of the exemplary smoking device 20 with the lid 36 partially removed, exposing the manifold member 34.

Figure 6A:
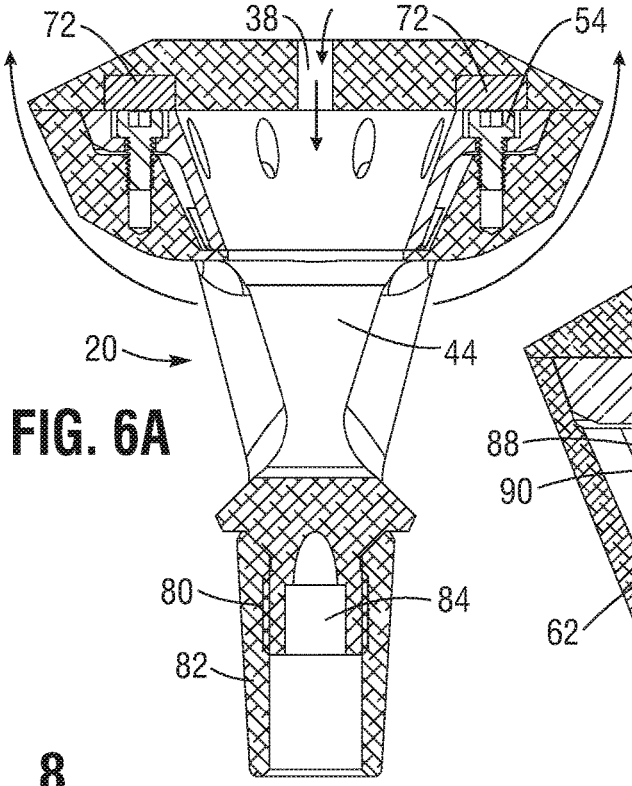
FIGS. 6A and 6B are vertical sectional views through the exemplary smoking device taken along lines 6A-6A and 6B-6B in FIGS. 3A and 3B, respectively.
Figure 6B:
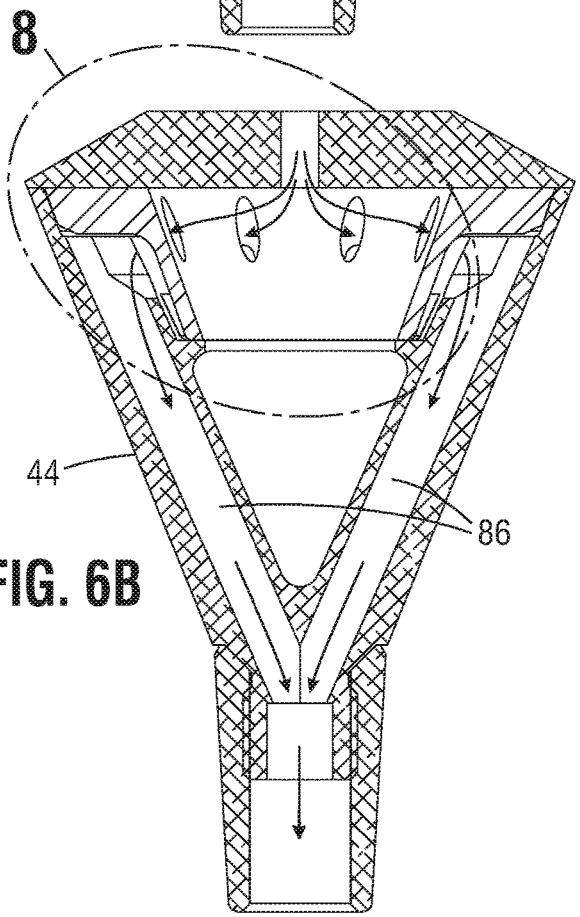

FIGS. 6A and 6B illustrate the cross-sectional shape of the manifold member 34 which also includes a downward and inwardly tapering flue 56 sized and shaped to fit loosely within the tapered walls of the smoking chamber 30. The flue 56 has side walls that define a central tapered receptacle 57 that opens upward. As will be seen below, when placed within the smoking chamber 30, the receptacle 57 provides a volume within which to deposit smoking material.

As seen in FIGS. 1A and 1B, the smoking chamber 30 terminates at a lower end in a circular ledge 58 which defines a central vertical opening 59 between the upper and lower portions of the main body 22. With reference to FIG. 4A, the burn plate 32 has a circular floor 60 having a diameter that closely matches the outer diameter of the circular ledge 58. In the illustrated embodiment, the burn plate 32 is cup-shaped with an upwardly and outwardly tapered side wall 62 that closely matches the taper of the outer walls of the smoking chamber 30. When placed on the circular ledge 58 over the central vertical opening 59, the underside of the burn plate 32 is exposed to the lateral throughbore 40 of the main body 22.

Now with reference to FIGS. 6A and 6B and the enlargements of FIGS. 7 and 8, the assembled components of the smoking device 20 will be described. As mentioned, the burn plate 32 is first inserted into the smoking chamber 30 so that it rests on and is supported by the circular ledge 58. The manifold member 34 is then positioned over the burn plate 32 and secured in place with the fasteners 54. The lower end of the inwardly tapering flue 56 defines a circular opening which exposes the floor 60 of the burn plate 32.

After placing a quantity of smoking material 70 onto the burn plate 32 (FIG. 7), the user covers the smoking chamber 30 with the upper lid 36. In a preferred embodiment, the upper lid 36 has one or two magnets 72 (FIG. 6A) facing downward that register with the ferromagnetic fasteners 54 to hold the lid in place. This advantageously enables quick release and re-attachment of the lid 36 without having to deal with fasteners or other such nuisances. Of course, the lid 36 may be held in place with such fasteners, or with a latch or other such more secure closure.

Figure 7:
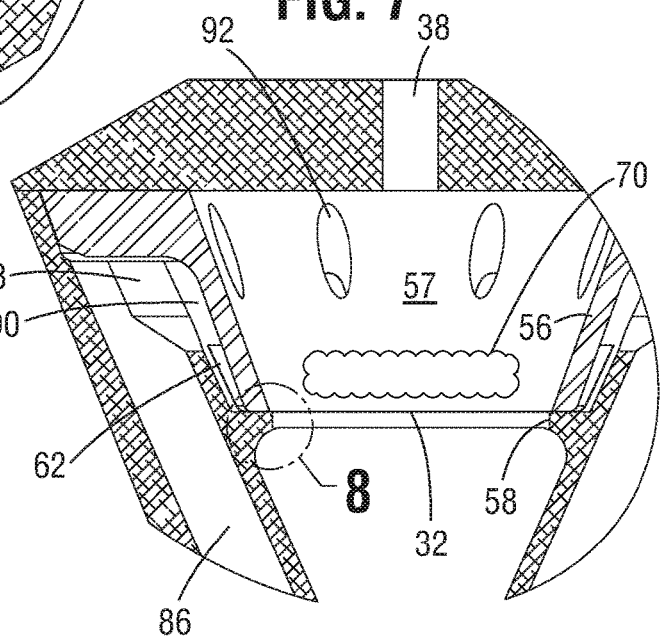
FIG. 7 is an enlarged view of a portion of FIG. 6B.
Figure 8:
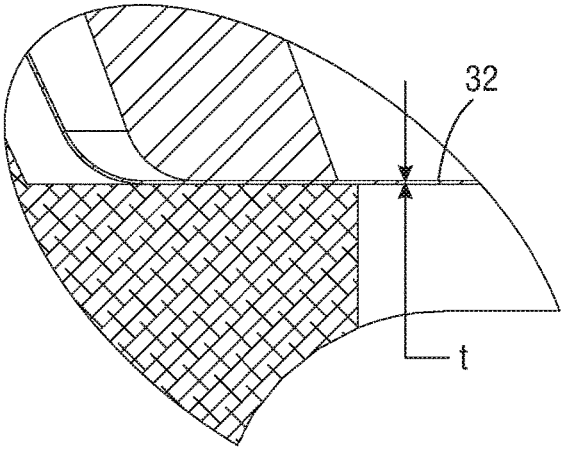
FIG. 8 is an enlarged view of a portion of FIG. 7.

FIGS. 7 and 8 illustrate how the lower end of the manifold member 34 contacts the burn plate 32 and clamps it against the internal circular ledge 58 of the main body 22. The fasteners 54 ensure that the manifold member 34 presses down on the burn plate 32. As will be explained, this tight fit isolates smoke byproducts of the smoking material 70 from gases produced by a lighter flame directed into the lateral throughbore 40 used to ignite the smoking material. It should be understood that the burn plate 32 may be held against the internal circular ledge 58 in a variety of ways, including forming the upper portion of the main body 22 in two separable parts. The usage of the manifold member 34 secured with fasteners to the main body 20 is thus just one convenient and elegant solution of many. One benefit of having a manifold member 34 is that it can be cleaned or replaced after a period of time if it becomes clogged with oils or resin or is otherwise unusable. The circumferentially spaced ports 92 preferably extend straight through the tapered walls of the flue 56 and are thus easily cleaned out.

In the illustrated embodiment, the tapered side wall 62 of the cupped burn plate 32 extends upward between the flue 56 of the manifold member 34 and the surrounding walls of the smoking chamber 30. This overlap prevents liquid smoke material 70 or liquids formed by combustion of the smoking material from seeping downward from the upper portion of the main body. In an alternative embodiment, a flat burn plate 32' as seen in FIG. 4B may be utilized if the smoking material 70 is relatively dry and there is less chance of liquid formation. It should be understood that the term "burn disc" refers to any thin, plate-like element which can be fit within the smoking chamber 30 and clamped therein to cover the central vertical opening 59 between the upper and lower portions of the main body 22. The term "disc" is used because the exemplary embodiments are circular. However, the "disc" could equally be square, polygonal, or some other shape depending on the internal shape of the smoking chamber 30, and thus the term "burn plate" will be used in the claims below to cover a variety of shapes.

To operate, a user places a quantity of smoking material 70 into the central tapered receptacle 57 of the manifold member 34 and onto the burn disc or plate 32, and secures the upper lid 36 over the open upper end 26 of the main body 22. The lower end 24 has a threaded interface 80 that may be directly connected to a pipe or other smoking system, or a tapered adapter 82 may be secured thereto for mating with a larger smoking system. Standard pipe or smoking system connectors are threaded 14 mm bores or tapered 18 mm receptacles. Of course, these dimension and connector types may change depending on the need. In any event, the smoking device 20 is connected to a larger smoking system such that a user can aspirate air downward through a lower passageway 84 in the lower end 24.

The lower passageway 84 connects to a pair of diverging flow channels 86 (FIG. 6B) extending through the aforementioned legs 44 of the main body 22. The flow channels 86 open upwardly at recessed regions 88 in the inner ledge 50, as seen in FIG. 1A. With reference to the enlargement of FIG. 7, the recessed regions 88 fluidly communicate with an annular space 90 defined around the tapered flue 56 of the manifold member 34. The manifold member 34 defines a plurality of ports 92 spaced circumferentially and extending through the tapered walls that define the flue 56. As a result, suction in the flow channels 86 creates a negative pressure within the annular space 90 and pulls air outward from the combustion chamber through the ports 92. It should be understood that the main body 22 may be formed with only one of the flow channels 86 through one of the legs, which reduces manufacturing cost without markedly altering the flow characteristics.

The user directs the flame of a lighter into the lateral throughbore 40 so that it comes in contact with the underside of the burn plate 32. Because the burn plate 32 is relatively thin, the heat transferred therethrough ignites the combustible material 70, thus creating smoke within the smoking chamber 30. As explained above, the smoke is then drawn outward through the ports 92 and eventually downward through the lower passageway 84 into the larger smoking system, as seen in FIGS. 6A and 6B.

The burn plate 32 is desirably formed out of a material and floor thickness such that there is rapid heat transfer therethrough so that the heat from the lighter can easily combust the smoking material 70. For the purpose of definition, the burn plate 32 has "substantially instantaneous and complete heat transmissivity" through its thickness so as to transfer the heat from a flame substantially instantaneously and completely from one side to the other. The term "substantially" is used as any barrier, even a thin foil-like barrier such as the burn plate 32, absorbs a minimum of heat energy or otherwise interferes with perfect heat transfer through its thickness. Stainless steel is a suitable material, though other metals that can be used include titanium and copper. In one embodiment, the burn plate 32 is made of metal (e.g., stainless steel) and has a floor thickness of at least 0.001 inches (0.025 mm). The thickness of the floor can be less, but is preferably not greater than 0.005 inches (0.127 mm), and more preferably no greater than 0.003 inches (0.076 mm). Because the manifold member 34 can easily be removed, the burn plate 32 can be replaced with a new one if deposits form on its upper surface, or if it burns through from excessive heat. Similarly, some people prefer smoking from glass, and thus glass (e.g., crystal) is a possible material that can be used as a burn plate 32. Such glass discs can be made as thin as 0.055 inches (1.4 mm). Other materials that could be used include ceramics, metal alloys, stone, precious stones, etc.

In a preferred embodiment, the main body 22 and lid 36 are machined out of aluminum and anodized to produce various colors or tints. For example, the exterior of the main body 22 and lid 36 can be formed with an anodized black or gold surface. Alternatively, the main body 22 and lid 36 may be diecast aluminum, though a diecast formation method precludes anodizing. The manifold member 34 may also be machined aluminum, though stainless steel or titanium could be used.

The flow arrows in FIGS. 6A and 6B perhaps best illustrate the beneficial separation of the smoke from the combustible material 70 from the gases created by the lighter. That is, the central air intake port 38 through the lid 36 supplies fresh air to the smoking chamber 30. Hot gases created by the lighter under the burn plate 32 escape around the sides of the upper portion of the smoking device 20 and rise upward, thus being directed away from the air intake port 38. The lateral dimension of the upper portion of the main body 22 is designed so that no hot gases from the lighter will inadvertently be sucked into the air intake port 38. Of course, depending on wind and other environmental conditions, small amounts of the gas produced by the lighter may inadvertently enter the smoking chamber 30, though the instances of this will be very rare.

The shape of the smoking device 20 may be modified from that illustrated, but a tapered main body 22 is desire. As seen in FIGS. 1-3, the main body 22 preferably has an upwardly tapered and faceted exterior shape, such as six facets as shown for aesthetic reasons. The lid 36 also has a plurality of facets that match the exterior facets of the main body 22. In one embodiment, the lid 36 has a trapezoidal cross-section across any two of the opposing facets. This tapered shape allows the user to bring the flame of the lighter in close underneath the burn plate 32, while providing good separation between the hot rising gases of the lighter and the intake port 38 in the center of the lid 36.

In one embodiment, the overall axial height of the smoking device 20 from the lower end 24 to the lid 36 is less than 3 inches, with the axial height of the main body 22 being approximately 2 inches. FIG. 3B illustrates the height $h_1$ of the main body 22 and lid 36 as well as the height $h_2$ of the lower adapter 82. In a preferred embodiment, the height $h_1$ is between 2.0-2.25 inches, and the height $h_2$ is less than 1.0 inches. FIG. 3C indicates lateral dimensions A and B across, respectively, the straight sides of the hexagonal sided lid 36 and the apices thereof. In a preferred embodiment, the distance A is between about 1.5-2.0 inches, while the dimension B is between about 1.8-2.3 inches. The width of the upper end of the smoking device 20 should be enough to ensure no hot rising gases of the lighter reach the intake port 38 in the center of the lid 36, without becoming overly bulky.

Figure 11:
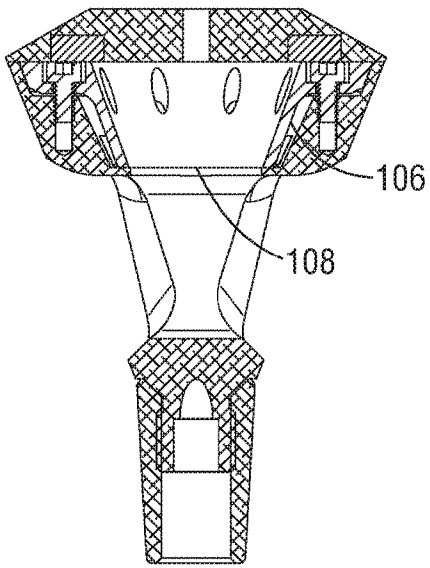
FIG. 11 is a vertical sectional view through the alternative smoking device taken along line 11-11 in FIG. 10A.
Figure 10B:
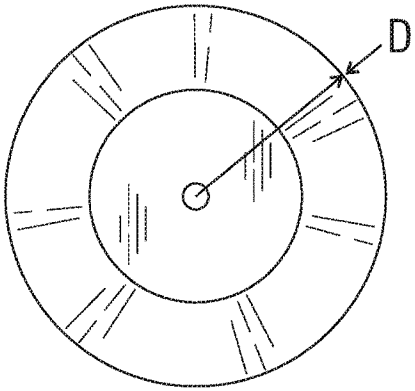
FIG. 10B is a top plan view thereof.
Figure 10A:
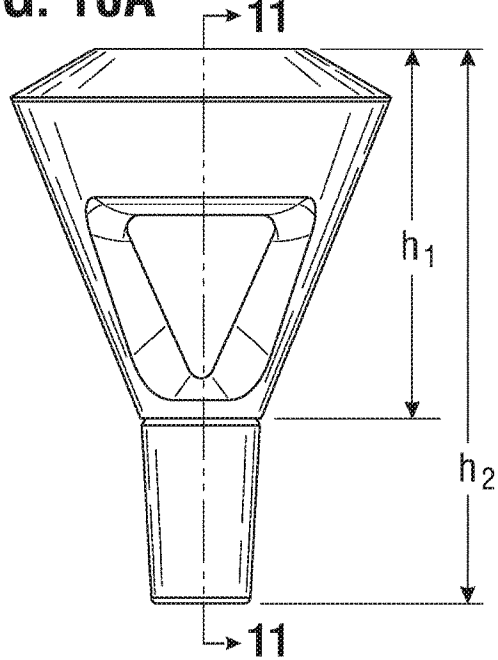
FIG. 10A is a side elevational view of the alternative smoking device.
Figure 9:
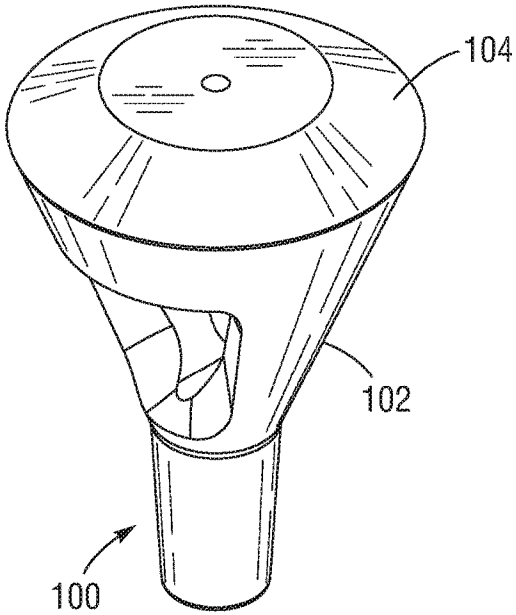
FIG. 9 is a perspective view of an alternative smoking device of the present application.

In an alternative configuration, as seen in FIGS. 9-11, a smoking device 100 has generally the same configuration as the smoking device 20, but without the facets. Instead, the exterior of the main body 102 is aesthetically smooth and conical, and in the same way the upper surface of the lid 104 is frustoconical. As before, the smoking device 100 includes a manifold member 106 and a burn disc 108 therein. In all other aspects, the smoking device 100 may be the same as the earlier-described smoking device 20. Another similar shape that could be utilized though it is not illustrated, is a flattened wedge-shape, wherein the main body 22 is tetrahedral- or pyramidal-shaped.

Figure 12:
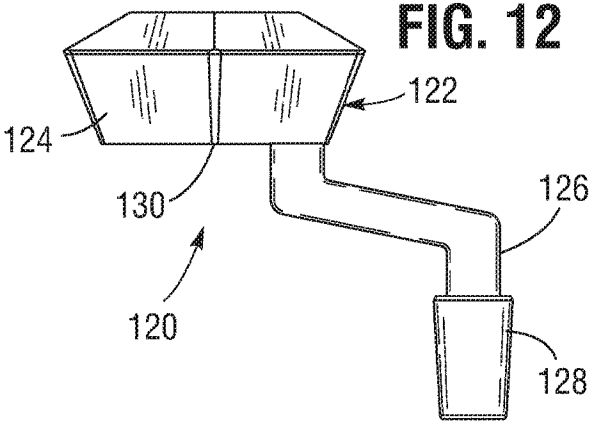

Other shapes are contemplated, such as one that is schematically shown in FIG. 12. The alternative smoking device 120 has a main body 122 with an upper portion 124 that is much like the upper portion of the main body 22 described above. However, rather than having a lower portion that extends directly downward, the lower portion 126 first extends laterally and then downward to an adapter 128. Rather than a lateral throughbore below the upper portion 124, a space is formed directly below a burn disc 130. The inner flow channels in the smoking device 120 as described above all collect and pass through the angled lower portion 126, which may be angular as shown or more serpentine.

This design permits a flame source to be held directly under the burn disc 130, potentially reducing the amount of exposure needed for combustion and thus lessening the chance any gasses from the combustion source are inhaled.

Although the invention has been described and illustrated with a certain degree of particularity, it is understood that the present disclosure has been made only by way of example, and that numerous changes in the combination and arrangement of parts can be resorted to by those skilled in the art without departing from the scope of the invention, as hereinafter claimed.

It is claimed:

1. A smoking device, comprising:

a main body defining an upper portion opening upward, the upper portion having inner walls that define a smoking chamber and an inner ledge that forms a central opening at the bottom of the smoking chamber, the main body having at least one internal flow channel formed therein which opens to the smoking chamber and extends downward through a lower portion of the main body to a lower passageway;

a burn plate sized and shaped to be supported by the inner ledge and thus completely cover the central opening at the bottom of the smoking chamber;

a manifold member sized and shaped to fit within the smoking chamber of the main body, the manifold member being configured to be fastened within the smoking chamber and clamp the burn plate against the inner ledge, the manifold member having a central receptacle and ports through sidewalls to provide fluid communication between the central receptacle and the at least one internal flow channel in the main body; and a lid adapted to be secured to and cover the upper portion of the main body, enclosing the smoking chamber from above, the lid having at least one air inlet, wherein smoking material may be placed within the central receptacle of the manifold member and onto the burn plate and the lid secured to the upper portion of the main body, and wherein the smoking material may be combusted by application of a flame to the underside of the burn plate and aspiration by a user from the lower passageway to create a flow in through the air inlet of the lid through the ports in the manifold member, through the at least one internal flow channel in the main body and through the lower passageway.

2. The smoking device of claim 1, wherein the lower portion of the main body extends directly downward from the upper portion along a central axis and has two opposed legs each of which having one of the internal flow channels, wherein the legs converge at a lower end to define the lower passageway, and wherein a lateral through bore is defined between the legs and underneath the upper portion of the main body to provide a space under the burn plate for application of a flame.

3. The smoking device of claim 2, wherein upper ends of the internal flow channels are in fluid communication with an annular space defined around the manifold member and between the manifold member and the smoking chamber, and wherein the manifold member has a plurality of the ports circumferentially spaced therearound to fluidly connect the central receptacle and the annular space.

4. The smoking device of claim 1, wherein the lower portion of the main body extends laterally away from the upper portion and then downward to the lower passageway, the lower portion defining a single internal flow channel that opens to an annular space defined around the manifold and between the manifold member and the smoking chamber, and wherein the manifold member has a plurality of the ports circumferentially spaced therearound to fluidly connect the central receptacle and the annular space.

5. The smoking device of claim 1, wherein the upper portion of the main body has a tapered vertical cross-sectional configuration which widens as it progresses upward, and the smoking chamber defined within the upper portion is likewise tapered, and wherein the manifold member and the central receptacle defined therein are also similarly tapered.

6. The smoking device of claim 1, wherein the manifold member is secured within the upper portion of the main body with fasteners.

7. The smoking device of claim 1, wherein the lid is secured to the upper portion of the main body with magnets.

8. The smoking device of claim 1, wherein the main body and lid are formed of machined aluminum that has been anodized.

9. The smoking device of claim 1, wherein the lid has a single air inlet centrally located therein.

10. The smoking device of claim 1, wherein the burn plate is made of metal and has a floor thickness of between 0.001 inches (0.025 mm) and 0.005 inches (0.076 mm).

11. The smoking device of claim 1, wherein the burn plate is cup-shaped with an upwardly and outwardly tapered side wall surrounding a floor that covers the central opening at the bottom of the smoking chamber.

12. A smoking device, comprising:

a main body defining an upper portion opening upward, the upper portion having inner walls that define a smoking chamber and an inner ledge that forms a central opening at the bottom of the smoking chamber, the main body having at least one internal flow channel formed therein which opens to the smoking chamber and extends downward through a lower portion of the main body to a lower passageway;

a burn plate sized and shaped to be supported by the inner ledge and thus completely cover the central opening at the bottom of the smoking chamber, the burn plate being clamped against the inner ledge and being formed of a material and having a thickness that enables substantially instantaneous and complete heat transmissivity and combustion of a smoking material placed on an upper face thereof from application of a flame to a lower face thereof;

a lid adapted to be secured to and cover the upper portion of the main body, enclosing the smoking chamber from above, the lid having a single air inlet centrally located therein, wherein smoking material may be placed within the central receptacle of the manifold member and onto the burn plate and the lid secured to the upper portion of the main body, and wherein the smoking material may be combusted by application of a flame to the underside of the burn plate and aspiration by a user from the lower passageway to create a flow in through the air inlet of the lid, through the at least one internal flow channel in the main body and through the lower passageway.

13. The smoking device of claim 12, wherein the lower portion of the main body extends directly downward from the upper portion along a central axis and has two opposed legs each of which having one of the internal flow channels, wherein the legs converge at a lower end to define the lower passageway, and wherein a lateral through bore is defined between the legs and underneath the upper portion of the main body to provide a space under the burn plate for application of a flame.

14. The smoking device of claim 13, wherein upper ends of the internal flow channels are in fluid communication the smoking chamber.

15. The smoking device of claim 12, wherein the lower portion of the main body extends laterally away from the upper portion and then downward to the lower passageway, the lower portion defining a single internal flow channel that opens to the smoking chamber.

16. The smoking device of claim 12, wherein the upper portion of the main body has a tapered vertical cross-sectional configuration which widens as it progresses upward, and the smoking chamber defined within the upper portion is likewise tapered.

17. The smoking device of claim 12, further including a manifold member secured within the upper portion of the main body and having a lower end adapted to clamp the burn plate against the inner ledge.

18. The smoking device of claim 12, wherein the lid is secured to the upper portion of the main body with magnets.

19. The smoking device of claim 12, wherein the main body and lid are formed of machined aluminum that has been anodized.

20. The smoking device of claim 12, wherein the burn plate is made of metal and has a floor thickness of between 0.001 inches (0.025 mm) and 0.005 inches (0.076 mm).

21. The smoking device of claim 12, wherein the burn plate is cup-shaped with an upwardly and outwardly tapered side wall surrounding a floor that covers the central opening at the bottom of the smoking chamber.

* * * * *